US005289596A

United States Patent [19]

Rose et al.

[11] Patent Number: 5,289,596

[45] Date of Patent: Mar. 1, 1994

[54] COMMODE OF UNITARY CONSTRUCTION

[75] Inventors: Eric P. Rose, Van Nuys; David Hodge, El Granada, both of Calif.

[73] Assignee: Guardian Products, Inc., Simi Valley, Calif.

[21] Appl. No.: 401

[22] Filed: Jan. 4, 1993

Related U.S. Application Data

[62] Division of Ser. No. 648,236, Jan. 30, 1991, Pat. No. 5,197,152.

[51] Int. Cl.[5] ..... A47K 11/00

[52] U.S. Cl. ..... 4/479; 4/234; 4/480; 4/483; 297/344.18; 248/118.2; 248/188.8

[58] Field of Search ..... 4/234-237, 4/239, 240, 449, 460, 464, 465, 468, 469, 476-486; 220/771, 914; 297/283, 311, 337, 338, 345, DIG. 2; 248/161, 172, 188.2, 188.3, 188.5, 188.9, 188.91

[56] References Cited

U.S. PATENT DOCUMENTS

| | | | |
|---|---|---|---|
| D. 284,718 | 7/1986 | Massonnet | D6/375 |
| D. 287,673 | 1/1987 | Verschuren . | |
| D. 295,588 | 5/1988 | Heitlinger et al. . | |
| D. 296,395 | 6/1988 | Polacsek . | |
| D. 313,515 | 1/1991 | Wood . | |
| 577,136 | 2/1897 | Honeywell . | |
| 784,950 | 3/1905 | Lindsay . | |
| 1,017,675 | 2/1912 | King . | |
| 1,408,114 | 2/1924 | Mathieu . | |
| 1,508,888 | 9/1922 | Klatt . | |
| 1,849,835 | 3/1932 | Jantzen et al. | 248/188.9 |
| 1,947,373 | 2/1934 | Bickel | 4/239 |
| 2,146,206 | 2/1939 | Elliott . | |
| 2,262,204 | 11/1941 | Rideout . | |
| 2,461,160 | 2/1949 | Joyce . | |
| 2,649,147 | 8/1953 | Sanford . | |
| 2,662,229 | 12/1953 | Wenkstern | 4/476 |
| 2,677,414 | 5/1954 | Abramovitz . | |
| 2,750,709 | 6/1956 | Saverino . | |
| 2,820,969 | 1/1958 | Wedge . | |
| 2,936,826 | 5/1960 | Reineman . | |
| 3,078,470 | 2/1963 | Rosenfeld . | |
| 3,107,360 | 10/1963 | Van Syoc Sr., et al. . | |
| 3,173,723 | 3/1965 | Hoven et al. . | |
| 3,215,469 | 11/1965 | Wamsley | 4/480 X |
| 3,258,291 | 6/1966 | Ezquerra | 4/483 X |
| 3,343,179 | 9/1967 | Sellars, Jr. et al. | 4/239 |
| 3,364,478 | 1/1968 | Waard . | |
| 3,391,408 | 7/1968 | Anderson | 4/480 |
| 3,601,822 | 7/1969 | Weiss | 4/234 |
| 3,637,256 | 1/1972 | Harty . | |
| 3,716,872 | 2/1973 | Zieman . | |
| 3,795,923 | 3/1974 | Thomas . | |
| 3,829,908 | 8/1974 | Thomas . | |
| 3,854,773 | 12/1974 | Thomas . | |
| 3,874,726 | 4/1975 | Sebel et al. . | |

(List continued on next page.)

FOREIGN PATENT DOCUMENTS

| | | | |
|---|---|---|---|
| 1111353 | 7/1961 | Fed. Rep. of Germany | 4/482 |
| 1529443 | 5/1969 | Fed. Rep. of Germany . | |
| 2637486 | 4/1990 | France . | |
| 306618 | 2/1928 | United Kingdom . | |
| 2084458 | 4/1982 | United Kingdom . | |

OTHER PUBLICATIONS

Guardian Products, Inc. Brochure, dated 1986, Section 5.

*Primary Examiner*—J. Casimer Jacyna

*Attorney, Agent, or Firm*—Willian Brinks Hofer Gilson & Lione

[57] ABSTRACT

A commode chair of unitary molded plastic construction having chair legs, a seat and a chair back. The seat comprises an upper and a lower seat section, at least one of which comprises a toilet seat with a central opening. The toilet seat has a seating surface sculpted and configured in molded form to accommodate and support the posterior of the human anatomy in the seating position. A commode bucket is provided which is supported by the lower seat section and depends downwardly through the central opening therein.

10 Claims, 7 Drawing Sheets

U.S. PATENT DOCUMENTS 3,905,051 9/1975 Gozdziewski .
3,959,833 6/1976 Burke .
4,002,369 1/1977 Jennings ..... 297/DIG. 2
4,199,826 4/1980 Devereux .
4,287,619 9/1981 Brewer et al. .
4,341,419 7/1982 Sebel .
4,457,029 7/1984 Matthews ..... 4/237
4,469,377 9/1984 O'Rourke ..... 297/DIG. 2
4,550,455 11/1985 Carson et al. ..... 4/480
4,592,097 6/1986 Zimmerman .
4,680,816 7/1987 Colombani .
4,777,672 10/1988 Gebhard et al. .
4,823,412 4/1989 Spiegel ..... 4/483
4,823,412 4/1989 Spiegel .
4,856,845 8/1989 Massonnet .
5,044,691 9/1991 Guichon ..... 297/DIG. 2
5,060,896 10/1991 Hobbins .
5,068,927 12/1991 Massaro .
5,123,126 6/1992 Vincent ..... 4/480

COMMODE OF UNITARY CONSTRUCTION

This is a divisional of U.S. Pat. No. 5,197,152 issued Mar. 30, 1993 which was application Ser. No. 07/648,236 filed Jan. 30, 1991.

BACKGROUND OF THE INVENTION

The present invention relates generally to a commode chair. More particularly, the invention is directed to a commode chair which is comfortable for the user and which may be used by hospital patients, disabled persons and invalids. Still more particularly, the invention is directed to a commode chair of substantially unitary construction which is made of light weight plastic, is stain resistant and readily cleanable.

The special needs of infirm or handicapped persons for comfortable and convenient toilet seating facilities have been known for a long time. However, many existing commode chairs are not comfortable for the long term user, are unsightly, and are constructed of materials and in designs which make them difficult to clean and maintain in sanitary condition. Commode chairs heretofore known are exemplified by the commode described in Bard, U.S. Pat. No. 276,931 which comprises a metal frame with a conventional toilet seat supported therein and a bucket disposed beneath the toilet seat. A portable commode chair designed to provide some degree of comfort and to be less conspicuous is described in Honeywell, U.S. Pat. No. 577,136 and Gozdziewski, U.S. Pat. No. 3,905,051. However, these commode chairs and others heretofore known do not provide the degree of comfort desired or the ability to readily maintain them in a sanitary condition. Furthermore, many of the known commode chairs do not have the capability of being useable both in conjunction with conventional toilet facilities and as bedside commodes as well.

In addition to the foregoing, existing commode chairs are not comfortable for the long term user because most body weight is typically supported under the ischial tuberosities when seated. On a toilet seat, the majority of weight is supported by only a narrow portion of the thighs, which exerts high pressures that may restrict blood flow. When seated for an extended time period, such a condition may cause extreme discomfort and possibly even physical damage. The risk of injury is increased further with toilet seats wherein the buttocks protrude through the central opening below the seat level causing even greater rearward angling of the thighs thereby transferring weight to the thighs and presenting a further potential risk of concentrating the load at a single area at the patient's legs in the front of the seat, which can reduce or cutoff blood circulation.

Many commode chairs previously known have been also designed with side arms or support rails which swing away from the seat or drop downwardly. In such devices, the arms have proven unstable and may cause the user to feel insecure due to excessive wobble in arm components. Such instability is quite undesirable because of the user's need for firm and reliable support. Thus, any instability or insecurity is not only dangerous to, but also produces considerable discomfort for, the invalid, infirm or handicapped person who must use the device.

An additional shortcoming of many existing chairs is that waste products may sometimes be left in the waste collecting bucket for extended periods. As a result, odors escape from the bucket creating an unpleasant environment and considerable discomfort for the user as well as others in the area.

Ease of use of the commode chair is also important. The chair design should enable the user to be easily seated on the commode and to get up from it. Thus, the armrests which are used for support during these actions should be designed to accommodate the user's needs in this regard as well.

SUMMARY OF THE INVENTION

The present invention overcomes the foregoing and other shortcomings of the commode chairs heretofore known. In accordance with the present invention, there is provided a commode chair having a molded plastic construction. The commode chair comprises a unitary molded plastic structure in the form of a chair with a plurality of generally vertical legs, a generally horizontal seat with the front and rear thereof supported by the legs, and a chair back extending upwardly from the seat at the rear.

The seat comprises a lower seat section and an upper seat section. The upper seat section is hingedly connected to the lower seat section at the rear thereof such that the upper seat section is pivotable from a generally horizontal position where it is supported by the lower seat section to a generally vertical position where it rests against the chair back. At least the lower seat section has a central opening and at least one of the seat sections has an upper seating surface sculpted and configured in molded form to accommodate and support the posterior of the human anatomy in the seating position. The lower and upper seat sections have corresponding mating contacting surfaces in particular areas; such as at side edges across front and back. A removable commode bucket is supportable by the lower seat section from which the bucket depends downwardly through the central opening therein.

In one embodiment, the seat comprises a seat pan integrally molded with the frame and a toilet seat hingedly connected to the seat pan at the rear thereof such that the toilet seat is pivotable from a generally horizontal position wherein it is supported by the seat pan to a generally vertical position wherein it may rest against the chair back. The seat pan and toilet seat have aligned central openings and a bucket is provided that depends downwardly through the opening in the seat pan. The bucket is provided with a handle and the perimeter of the opening in the seat pan is molded with a recessed flange capable of supporting the commode bucket and the bucket handle. A bucket lid is also provided to cover and seal the opening in the toilet seat. The lid also serves as a lid for the bucket because the open end of the bucket is of the same shape as the openings in the toilet seat. The seating surface of the toilet seat is sculpted and configured in molded form to comfortably accommodate and support the posterior of the human anatomy in the seated position. A commode bucket liner may be provided to be supported between the seat pan and the toilet seat and hangs downwardly into the commode bucket. The use of a liner is advantageous for hygienic purposes.

In an alternative embodiment; the seat pan is sculpted and contoured to conform to the posterior of an occupant in the seated position so as to function as a toilet seat. A sculpted, pivotable toilet seat cover, without a hole, is hingedly connected to the toilet seat at the rear thereof. The surface of the cover facing the toilet seat is contoured reciprocally to the toilet seat so as to extend into and conform to the conformation of the toilet seat when in the horizontal position resting against the toilet seat. This same sculptured surface also serves as a lumbar support for the chair occupant when the cover is in the raised or substantially vertical position resting against the chair back. In this embodiment the cover has no central hole therein so that when it is in the horizontal position resting on the toilet seat, the upper surface of the cover also serves as a contoured seat surface of a chair and, as it mates with the toilet seat. The cover also serves as an odor seal.

The commode chair is further provided with integrally molded armrests on each side of the seat and the front of the lower seat section is advantageously curved downward in part and upward in part to conform to the upper legs of the human anatomy in a seating position. Desirably, the armrests are inclined downwardly toward the rear of the chair such that the vertical elevation of the armrests is greater at the chair front then the rear. This arm construction enables a person to enter and leave the chair more easily and with a minimum amount of knee flection.

The commode chair of the invention may also be provided with chair leg extenders for the chair legs to permit height adjustment of the chair. This feature enables the chair to be adjustable to the size and height of the individual user as well as to existing toilet facilities when the chair is used in conjunction therewith.

DESCRIPTION OF THE PREFERRED EMBODIMENTS

Figure 1:
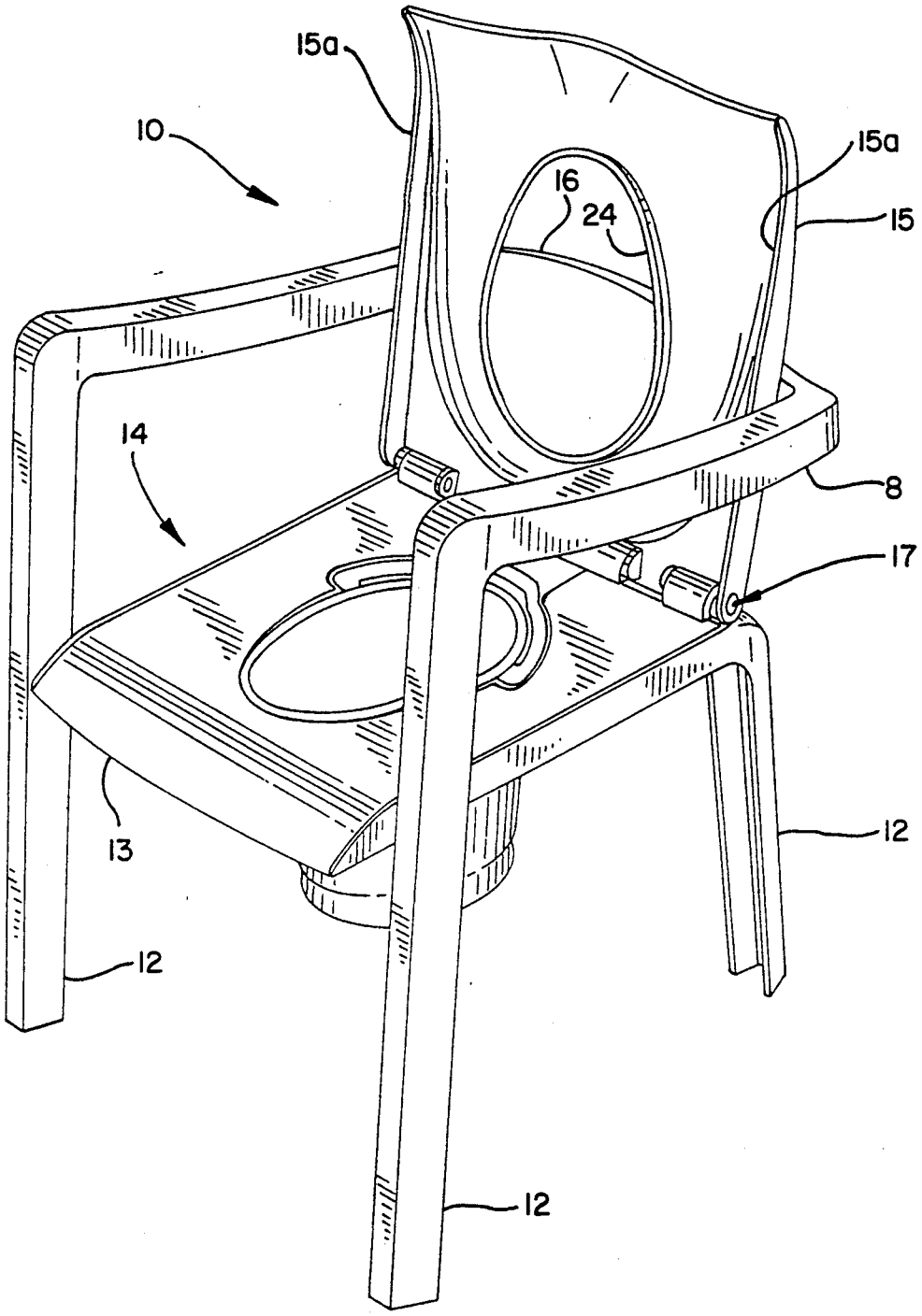
FIG. 1 is a schematic prospective view of one embodiment of the commode chair.

As can be seen in the accompanying drawings, wherein like numerals refer to like parts; the commode chair of the invention comprises a frame 10 which includes legs 12, seat member 14 comprising lower and upper seat sections 13 and 15, or 32 and 34, and chair back 16.

In the preferred embodiment shown in FIGS. 1–4, seat member 14 comprises, as the lower seat section, seat pan 13, and as the upper seat section, toilet seat 15. The seat pan 13 is integrally molded with the chair frame and is attached to and supported by legs 12. The toilet seat cover 15 is hingedly attached by hinge assembly 17 to the seat pan 13 at the rear thereof such that the toilet seat is pivotable from a generally horizontal position wherein it is supported by the seat pan 13, to a generally vertical position wherein it can rest against chair back 16. The seating surface of the toilet seat 15 is sculpted to provide a shape that conforms to the body posterior in a seated position.

Toilet seat 15 and seat pan 13 have aligned central openings 24 and 22, respectively, which are, advantageously, egg-shaped. Around the perimeter of the opening in the seat pan 13 is a recessed lip or flange 26 below the upper surface of the seat pan.

As seen in FIG. 1, armrests 8 are integrally formed with legs 12, chair back 16 and seat pan 13 to form a chair frame. Armrests 8 are inclined downwardly to the rear of the chair so that the vertical elevation of the armrests at the chair front is higher than the vertical elevation of the armrests at the rear of the chair.

The legs 12 are preferably truncated triangles in cross section and are additionally supported at the front of the seat pan 13, for example, by a large fillet. The rear legs 12 and the rear of the seat pan 13 are integrally formed together. The armrests 8 are formed continuous with the front legs 12 and with the back 16.

As indicated previously, an important aspect of the invention as shown in the drawings is that the upper seating surface of the toilet seat, in this case upper seat section 15, is sculpted and configured in molded form to comfortably accommodate and support the posterior of the human anatomy in the seating position. The surface of the toilet seat 15 which contacts the seat pan 13 when in the generally horizontal position is designed to mate with seat pan 13 side flanges or lips 15*a* are provided to stabilize the toilet seat. A commode bucket lid 20, shown in FIGS. 3 and 4, covers and seals the hole in the toilet seat when not in use. The lid 20 is also designed to function as a lid for the bucket 18, as hereinafter described.

Figure 2:
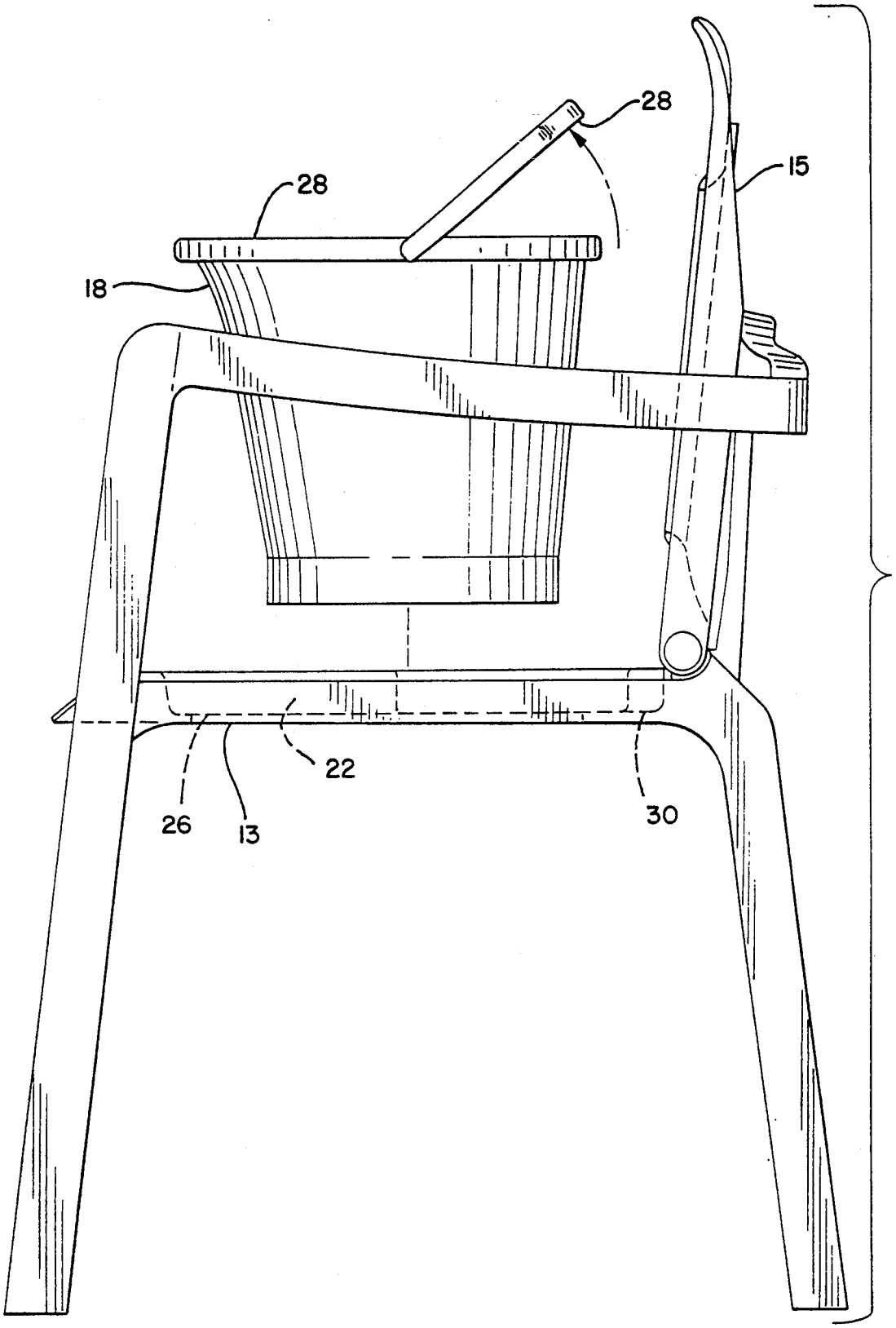
FIG. 2 is a side schematic prospective view of the commode chair; shown in FIG. 1, in exploded view, showing the chair and commode bucket.
Figure 3:
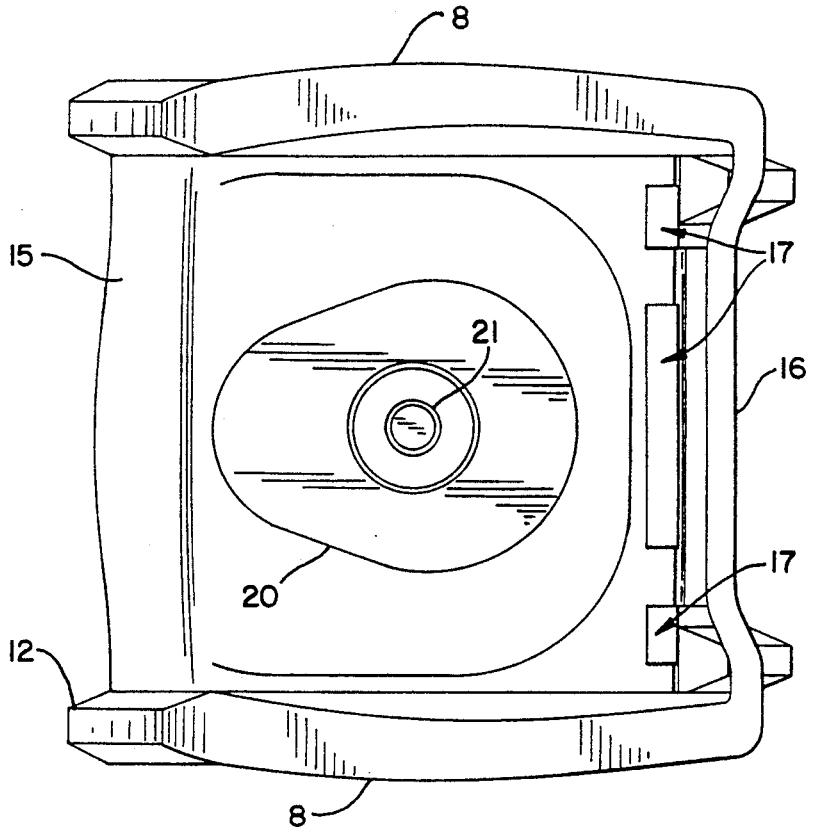
FIG. 3 is a top plan view of the commode chair shown in FIG. 1.
Figure 5:
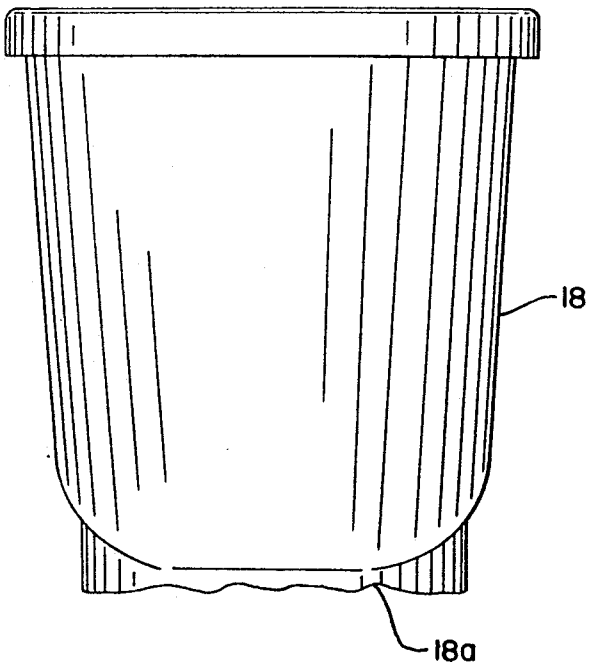
FIG. 5 is an elevational view of the commode bucket.

The bucket 18 shown in FIGS. 2 and 5, is suspended from the seat pan 13 where it is supported around its rim 28 by resting on the lip 26 of the perimeter of the hole 22 in the seat pan. A bag liner, not shown, may be used to extend into the bucket to facilitate disposal of the waste. Any suitable liner may be used for this purpose and the liner may also be provided with gelling agents, as known in the art. The bucket 18 may be provided with a scalloped edge 18*a* to aid in manipulating the bucket to dispose of its contents.

Figure 4:
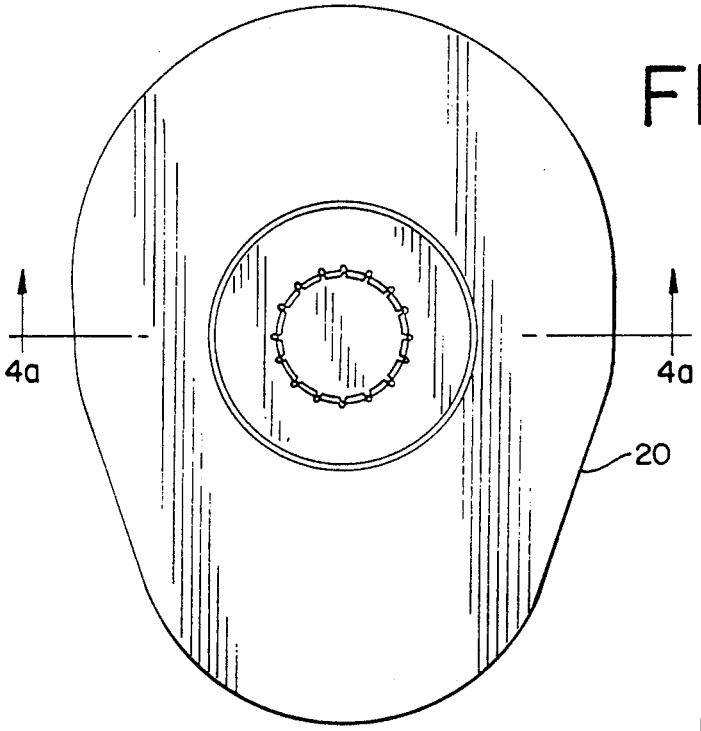
FIG. 4 is a plan view of the bucket lid and FIG. 4*a* is a cross sectional view of the lid taken along lines 4*a*—4*a* of FIG. 4.
Figure 4A:
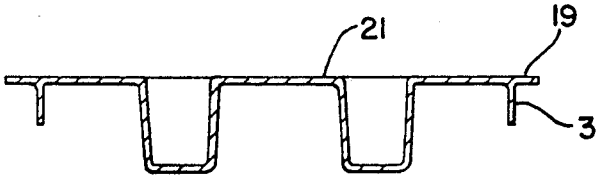

As mentioned previously, a lid 20, shown in FIGS. 4 and 4*a*, is provided to cover and seal the toilet seat hole when the commode chair is not in use. The open end of the bucket 18 is similarly configured to the shape of the toilet seat hole and the lid is thus also able to function as a cover for the bucket as well. The lid 20 has a central projecting portion 21 by which it may be grasped and a peripheral lip 19 and flange 3 which seats on and in the peripheral rim 26 of the hole in the lower seat section.

Figure 6:
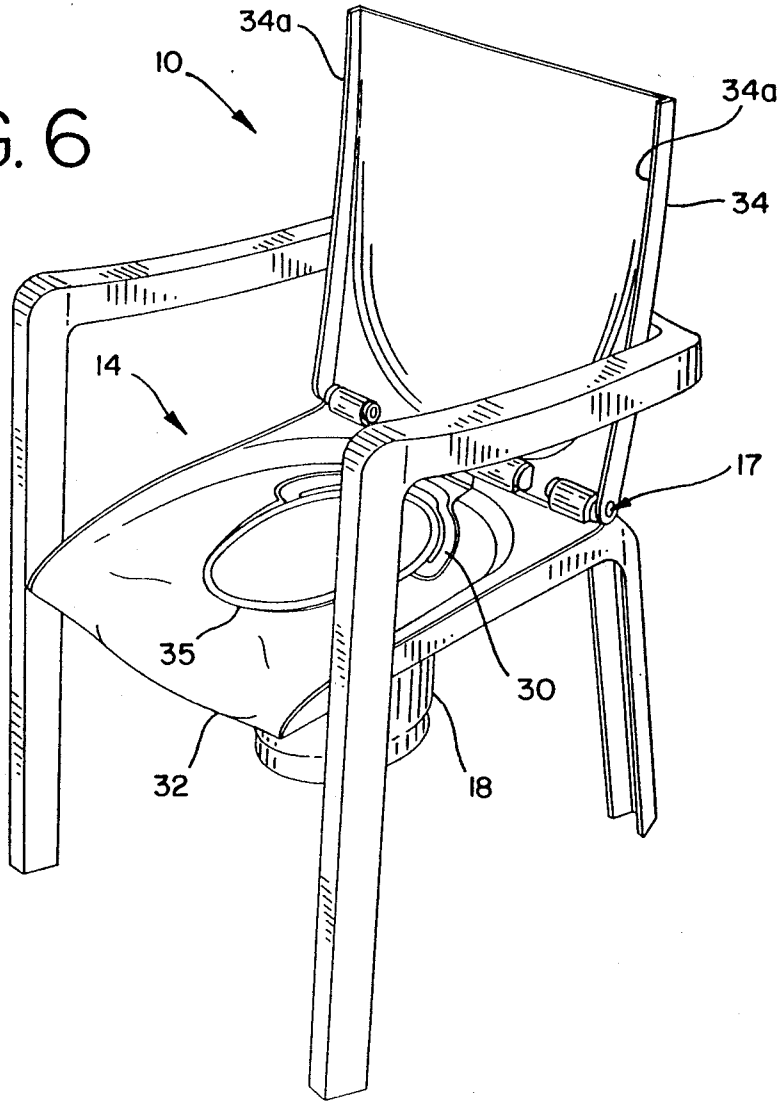
FIG. 6 is a schematic prospective view of another embodiment of the commode chair.
Figure 7:
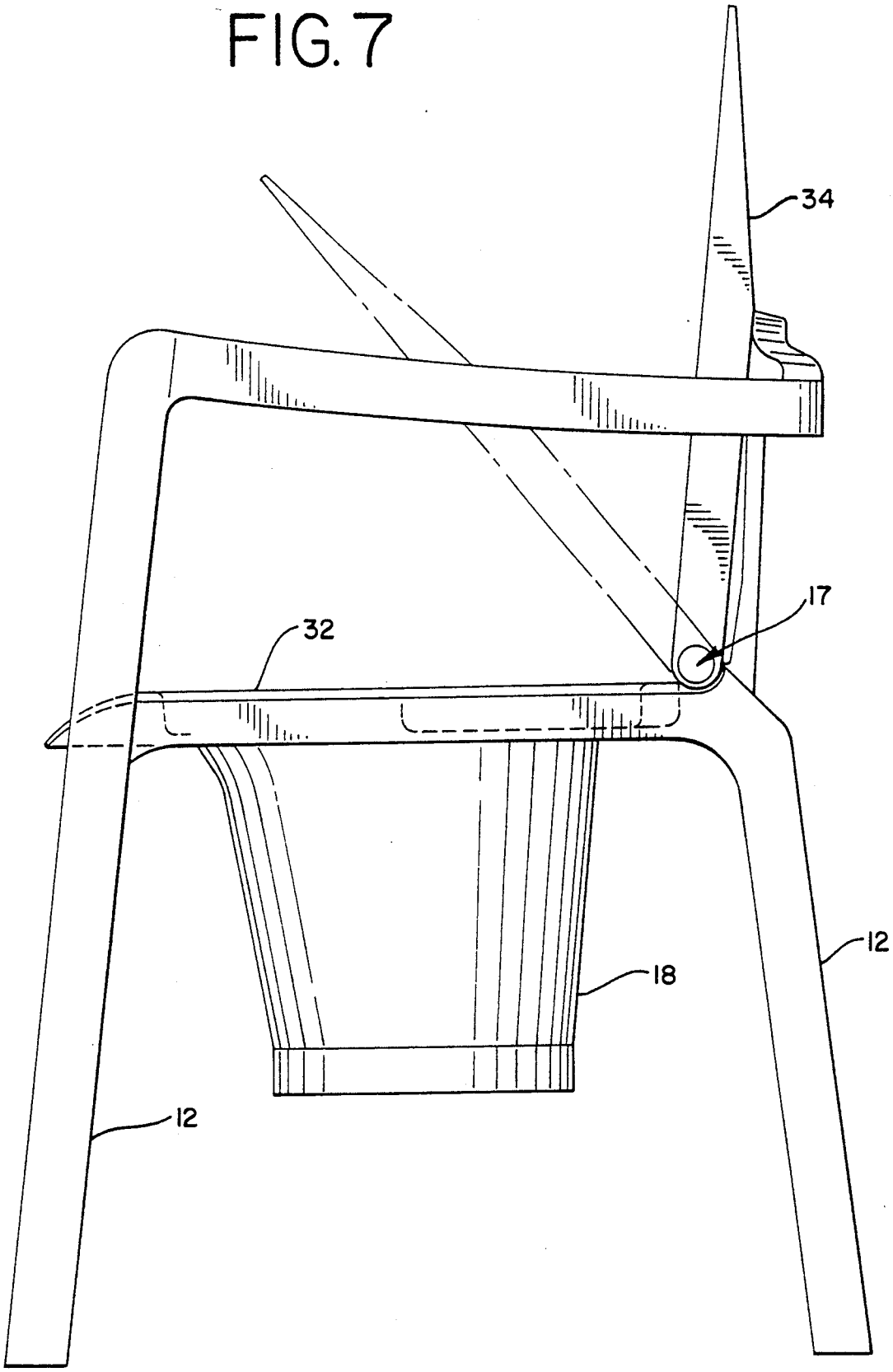
FIG. 7 is a schematic side elevational view of the embodiment shown in FIG. 6 with the cover raised.
Figure 8:
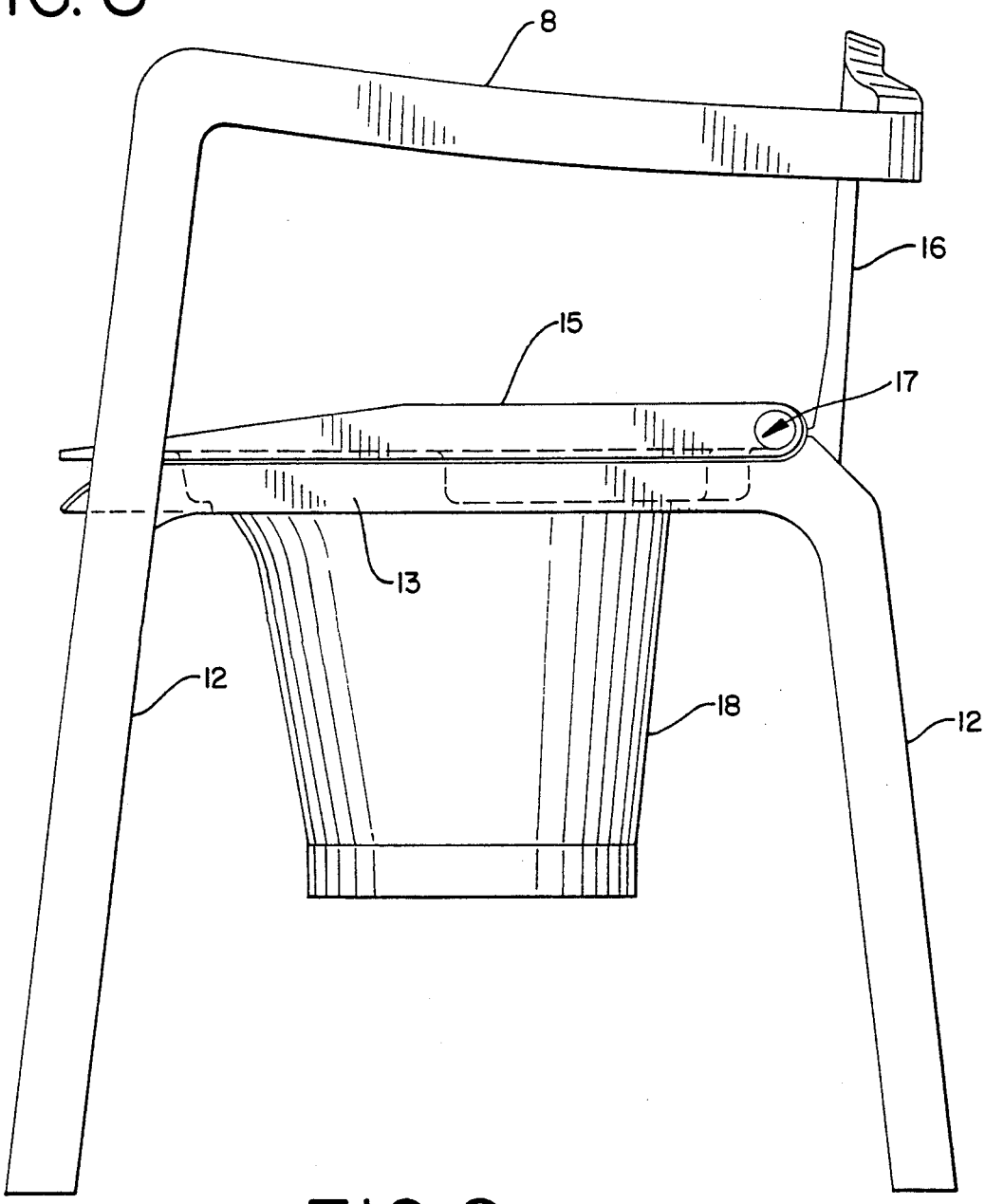
FIG. 8 is a schematic side elevation view of the commode chair shown in FIG. 6 with the cover down.
Figure 9:
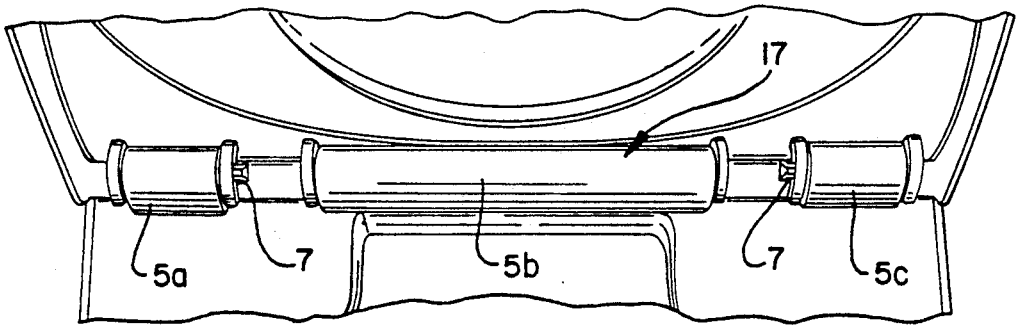
FIG. 9 is a prospective view of the hinge assembly.

In the alternative embodiment shown in FIGS. 6–8, the commode chair also comprises a frame 10 which includes a seat 14; however, the lower seat section 32 in this embodiment is sculpted to function as a toilet seat instead of being a seat pan for a toilet seat as in the previously described embodiment.

The lower seat section 32 is sculpted and configured to conform to the human body posterior in the seated position. In this embodiment, the upper seat section 34 does not function as a toilet seat and does not have a central hole. Instead, the upper seat section 34 is a toilet seat cover and is sculpted reciprocally to the toilet seat 32 so that it may lay flush against the toilet seat when pivoted into the horizontal position. This same sculptured surface will then function as a lumbar support for a seated chair occupant when the cover 34 is pivoted to the substantially vertical position where it rests against the chair back 16. The reciprocal contouring of the under-surface of the cover 34 is thus also contoured to conform approximately with the shape of a person's back and provides good lumbar support.

An additional feature of this embodiment is that since the cover 34 is sculpted as the reciprocal of the sculpted toilet seat, when it is laid horizontally on the toilet seat, the upper side of the cover 34 forms a sculpted seating surface. Thus, when the commode chair is not in use as a commode, it may be used as a chair with a comfortable and supportive seating surface. Side flanges or lips 34*a* provide lateral stability.

As seen in FIGS. 6–8, the commode chair of this embodiment the lower seat section comprises toilet seat 32 and the upper seat section comprises cover 34. Bucket 18 is suspended from the opening 35 in the lower seat section, just as in the previously described embodiment. Toilet seat 32 is sculpted and configured to provide a shape which accommodates and supports the posterior of the human anatomy in the seating position, just as the toilet seat in the other embodiment. Cover 34 is similarly sculpted and configured so that the surface thereof which contacts the toilet seat when the cover is in the generally horizontal position conforms to the surface of the toilet seat so the two contacting surfaces mate. This undersurface of the cover also serves as a lumbar support for the chair occupant when the cover is raised and rests against the chair back.

The opposite surface of the cover 34 is shaped like, and resembles the shape and contouring of the toilet seat. Thus, when the commode chair is not in use as a commode, the top of the cover when laid horizontally presents a sculpted and contoured seating surface which accommodates and supports the chair occupant's posterior.

The sculpting of the toilet seat 32 in the above described embodiment, includes configuring the front end thereof such that it is curved downward in part. The upper legs of the human anatomy in a seating position rest on the downwardly curved part. As in the other embodiment, the frame and seat are preferably made of a composite reinforced polypropylene by injection moldings.

Figure 10:
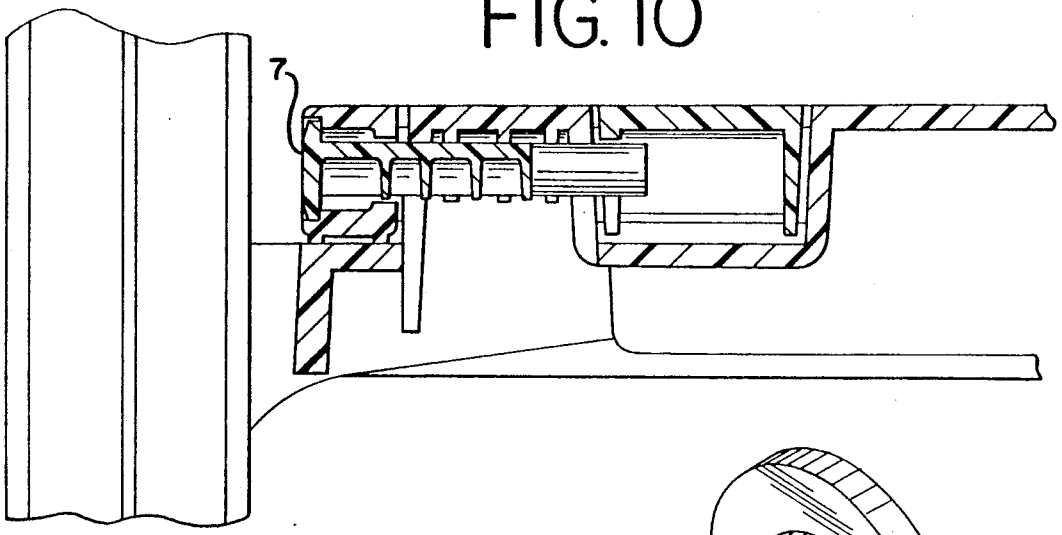
FIG. 10 is a detail view of the hinge assembly.
Figure 11:
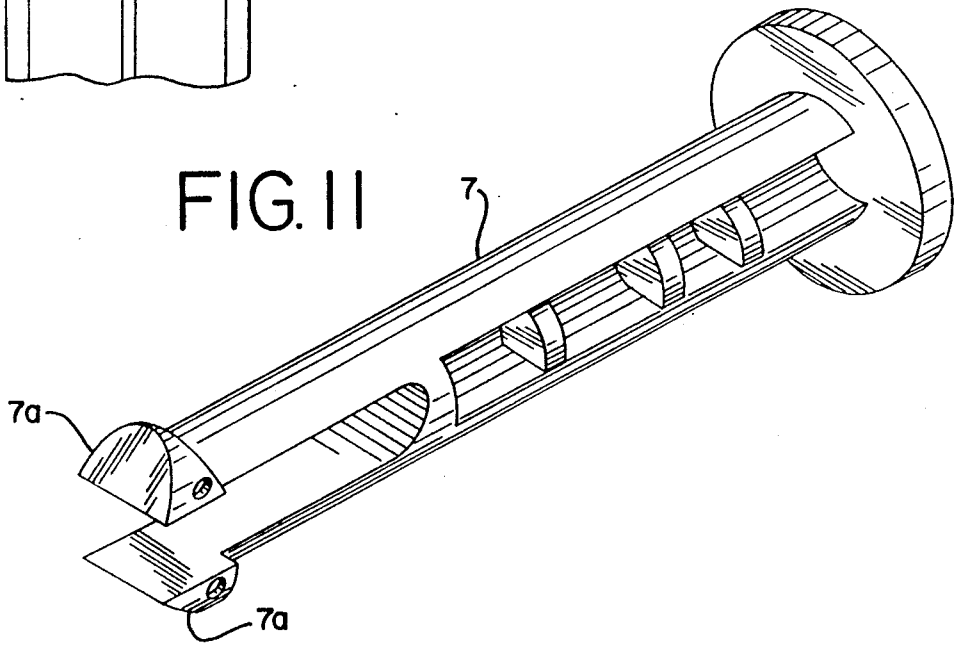
FIG. 11 is a prospective view of a hinge pin.

Also as in the previously described embodiment, the cover 34 is hingedly connected to the toilet seat 32 by means of hinge assembly 17 at the rear of the seat. Any suitable hinge construction may be used in both embodiments, but the assembly and parts shown in FIGS. 10–11 are preferred.

The hinge assembly 17 comprises open hollow cylindrical members 5*a* , 5*b* and 5*c* which may be integrally molded at the end of either the lower or upper seat sections. Corresponding open cylindrical members (not shown) of smaller outside diameter than members 5*a* , 5*b* and 5*c* may be molded to the other seat section and are designed to fit within the larger hollow cylindrical members. Pin 7 fits into the smaller diameter members and fasten the two mating cylindrical members in position as well as enabling the upper and lower seat sections to pivot with respect to each other. In a preferred embodiment of the hinge pin shown in FIG. 11, clips 7*a* are provided to hold the pin 7 in place.

In both embodiments, the upper seat section is preferably attached to the lower seat section by injection molded plastic hinge pins in hinge assembly 17 that are inserted into slots in the lower seat section and which fit in circular channels. The pins lock into place with clips 7*a* that are molded integrally with the pins.

By hingedly connecting the upper seat section 34 to the lower seat section 32, the upper seat section is pivotable from a generally vertical position wherein it is supported by chair back 16 to a generally horizontal position wherein it is supported by the toilet seat.

Thus, the cover 34 pivots up and down around the hinge point at the rear of the toilet seat. In the down position, it covers the entire toilet seat 32. Since the mating surfaces are reciprocally shaped, contact is made substantially along the entire mating surfaces. When cover 34 is upright, it comes to rest against the top edge of chair back 16. The front of the cover follows a horizontal contour that is nearly identical to that of the toilet seat so that when it is folded down an odor seal is formed with the seat along the areas of contact, aided in this regard by side flanges 34*a*.

The front edge of the cover 34 is slightly raised in the center to provide a space into which one can insert ones fingers when it is down so as to act as a finger grip. Structural rigidity is achieved through contouring and flanges 34*a* that run along the edge of the cover 34 and fit in channels in the toilet seat edge. While the user is in the seat this also provides side-to-side stability.

In both embodiments, commode bucket 18 depends from the lower seat section, e.g., the seat pan or toilet seat, and is also accessible through the hole in the lower seat section. The commode bucket 18 may be provided with a handle 28 and scallops 18*a* for convenient lifting, transporting and handling of the bucket.

Also in both embodiments, the toilet seat is formed with a large, egg-shaped hole in the center. In the first described embodiment, a similar hole is in both the seat pan and the toilet seat and these holes are aligned. The outer perimeter of the hole in the seat pan 13 is edged with a narrow, horizontal flange 26, as described, for supporting the bucket 18. The egg shaped hole is wider at the rear and is longer than in common toilet seats to minimize the possibility of waste soiling the seat.

The bucket 18 and handle 28 may be injection molded. The open top of the bucket 18 is of the same configuration, e.g. egg-shaped, as the toilet seat hole, i.e. narrower in the front than in the back. The bucket rim 26 rests on the flange 24 in the lower seat section, e.g., seat pan 13, or toilet seat 32, so that the bucket rim does not protrude above the toilet seat and is generally flush with the contours of the surface of seat pan or toilet seat 13 and 32, respectively. The bottom of the bucket 18 may be circular and the wall of the bucket may be angled more sharply in the front than in the sides and back. When placed on the floor, the bucket is able to sit flat. The rim may be slightly scalloped at the back to serve as a hand grip 18*a* when tilting the bucket to pour out its contents.

The bucket handle 28, when not in use, folds down into an indent 30 in the seat pan or toilet seat so that it creates a flush surface with the surface. The lower seat section is recessed an additional amount under the handle grip to provide finger clearance for the handle.

Figure 12:
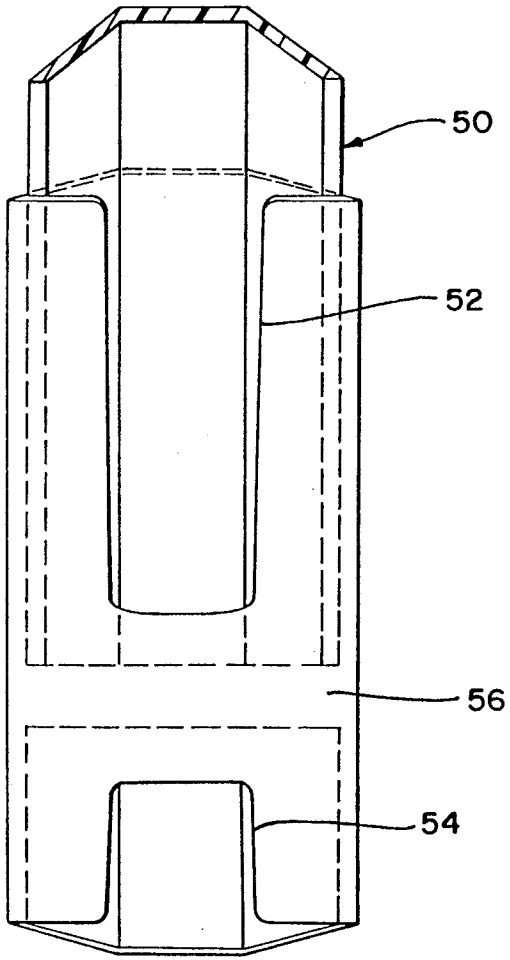
FIG. 12 is a schematic prospective view of a commode chair leg extender.

Leg extensions 50 as shown in FIG. 12 are advantageously provided to enable height adjustment of the chair. They comprise composite reinforced polypropylene injection molded parts. Four leg extensions, one for each leg of the commode, may be supplied with each commode chair. Their inside (e.g. interior) cross section conforms with the outside chair leg cross section. Slots 52 and 54 may be cut out of the back edge of the leg extension to facilitate it's placement and removal. To adjust the vertical elevation of the chair as necessary to conform to the height and size of the user, chair leg extensions 50 can be fitted at the ends of chair legs 12 to increase the vertical elevation of the seat.

The leg extensions 50 slide over each leg of the commode chair to raise it. A dividing platform 56 is provided on the internal perimeter of each leg extender against which the end of the chair leg is supportingly seated. The divider is located nearer one end of the leg extender so that different vertical adjustments are possible, depending into which end of the extender the chair leg is inserted. For example, if the leg extender is six-inches long and the internal divider is two-inches from one end, vertical adjustment may be two or four-inches, depending into which side of the extender the chair leg is inserted. When inserted into the extender, the chair legs 12 rest on the horizontal dividing platform of the leg extensions 50. Each end of the leg extension 50 is preferably angled so that it sits flat on the floor. Foot tips (not shown) made of injection molded rubber parts may be also provided to minimize the possibility of the chair sliding.

The plastic commode chair described is preferably made by injection molding. A suitable plastic material for construction is calcium carbonate-filled polypropylene. The single unitary structure which can be molded would include the legs 12, armrests 8, the flat or contoured and sculpted lower seat section 13 or 32 with the bucket rim or flange 26 and chair back 16.

Since the commode chair of the invention is of molded plastic construction, it is stain resistant and readily cleanable so as to be able to be maintained in sanitary condition. All surfaces and edges are designed to allow the commode to be wiped easily with a cloth and small crevices are kept to a minimum. Furthermore, in connection with the alternative embodiment, with the lid in the lowered position the commode chair does not present an unsightly appearance and can be used comfortably as a regular chair. The plastic chairs of both embodiments are also stackable two high so that they can be conveniently stored with minimum space requirements.

As described above, an important aspect of the invention is that the toilet seat in both described embodiments is sculpted to conform to the human anatomy in the seating position. Thus, the commode toilet seat is contoured to ensure contact with as much support surface as possible, including around the back of the buttocks and the thighs. The toilet seat is advantageously raised around the back and sides and the contouring also extends forward along the full length of the thigh where it is slightly concave to provide maximum thigh support. To ensure that excess pressure is not exerted under the thighs and that the load is evenly distributed over the entire contoured contact surface, the seat plane is flat and ends in a gentle radius at the front. Additional support is provided under the thighs since the toilet seat hole is narrowed toward the front ("egg-shaped") which provides maximum support without obstructing waste elimination.

To assist the user to sit on the commode and to get up, the armrest is angled backward to follow the natural angle at which the arm falls when sitting. When using the commode, the raised front edge of the armrest provides a surface against which one can support oneself during ingress and egress.

Frail people need to be able to support their weight with their arms as they lower themselves into a seat and push when they stand up. Ingress and egress into and out of the commode chair is made easier when the distance of descent and ascent is limited. The armrests of the commode chair are advantageously raised in the front so that they are within finger tip reach for a person standing erect. A person is able to back up to the chair and feel for the arms without bending over. They are able to take up their weight with their arms before they have descended to a point where the legs and knees are under most stress and most inclined to collapse. By pitching the seat forward slightly, the user can sit comfortably in the commode chair even though it may be slightly higher than a normal chair. The seat height can be adjusted to ensure that this angle is effectively maintained.

It is also important that the commode chair be as stable as possible. The legs of the commode are desirably angled outward about 7° and are attached to the extreme edges of the seat. The footprint of the chair therefore extends beyond all body contact surfaces, giving a stable base of support.

All surfaces, edges and radii of the commode chair are designed to allow the commode to be wiped down easily with a cloth. Small crevices are kept to a minimum but where they are necessary, they are advantageously provided with a radius at their bottom so that there is room for a cloth to be inserted. There are no ridges or sharp edges on the top side of the commode chair which would make cleaning more difficult. Furthermore, since the commode chair is made of plastic, it can be easily hosed down. Drain holes may be placed at any point where water might otherwise collect. No metal parts are included that might corrode or otherwise provide an unsightly appearance.

The present invention has been designed with aesthetics in mind so that it is not unsightly. It also departs dramatically from the starkness and institutional appearance of most other commodes and with the upper section down, it may be used as a chair.

In summary, the commode chair of the invention is aesthetically refined with due care given to the comfort of the user as well as to its appearance and practicality.

It is apparent from the foregoing that various changes and modifications may be made without departing from the spirit of the invention. For example, where materials or dimensions are given herein, they are only by way of example and the parts may be constructed with different dimensions and materials.

Accordingly, the scope of the invention should be limited only by the appended claims wherein, what is claimed is:

1. A commode chair having a molded plastic construction comprising:

a unitary molded plastic structure in the form of a chair with a plurality of generally vertical legs, a generally horizontal seat with a front and rear supported by said legs and a chair back extending upward from said seat at the rear thereof;

said seat comprising a seat pan and a cover, said cover being hingedly connected to said seat pan at the rear thereof such that the cover is pivotable form a generally horizontal position wherein it is supported by the seat pan to a generally vertical position wherein it can rest against said chair back;

said seat pan comprising a toilet seat having a central opening and an upper seating surface sculpted and configured in molded form to accommodate and support the posterior of the human anatomy in the seating position including a downwardly curved front portion for supporting the user's legs and a contoured recessed area surrounding the central opening on the sides and rear of the toilet seat, the surface of the cover which contacts the toilet seat when the cover is in the generally horizontal position being sculpted and configured in the molded form as the reciprocal of the toilet seat so as to provide a mating surface therefor and the opposite surface of the cover being thus configured similar to the toilet seat so as to also accommodate and support the posterior of the human anatomy in the seating position when in the generally horizontal position resting against the toilet seat;

said cover being capable, because of its surface configuration, of providing lumbar support for a commode chair occupant when the cover is in the generally vertical position resting against the chair back.

2. A commode chair according to claim 1, further comprising armrests integrally molded on each side of the seat.

3. A commode chair according to claim 2, wherein the vertical elevation of said armrests is greater at the chair front than the rear.

4. A commode chair according to claim 1, wherein the perimeter of the central opening in the toilet seat is molded with a recessed flange capable of supporting a commode bucket.

5. A commode chair according to claim 4, wherein said commode bucket is provided with an outwardly flared rim adapted to engage the recessed flange at the perimeter of the central opening in said toilet seat so that the bucket is suspended in the central opening and supported therein by said flange.

6. A commode chair according to claim 5 wherein the commode bucket further includes a foldable handle that folds down flush with the surface of the toilet seat section.

7. A commode chair according to claim 1, wherein a portion of the front of the cover is slightly raised in the center to allow finger access and act as a finger grip to raise the cover.

8. A commode chair according to claim 1, wherein the cover is attached to the unitary molded plastic structure at the rear of the toilet seat by molded plastic hinge pins inserted into slots in the toilet seat located in circular channels that extend at the rear of the toilet seat.

9. A commode chair according to claim 1, further comprising chair leg extensions, and a dividing platform to divide said leg extensions unequally internally such that insertion of one of the chair leg and the chair leg extensions into the other results in the commode chair being raised to either of two differing heights.

10. A commode chair, comprising:

(a) an integrally molded plastic chair having a lower seat member, front and rear legs integrally molded with said lower seat member, and a back member integrally molded with said lower seat member;

(b) said lower seat member having a downwardly curved front portion for anatomically supporting the user's legs, a central opening having an integrally molded recessed substantially horizontal flange around the periphery of said central opening, and a contoured area surrounding said central opening on the sides and rear of said lower seat member, said contoured area being generally depressed into said lower seat member so as to conform to the posterior of a seated human being;

(c) a removable commode bucket having an open top with a flange extending outwardly form the periphery of said open top; the removable commode bucket being located within and below said central opening, and the flange of the receptacle being supported by the recessed flange of the lower seat member, the receptacle flange not extending above the surface of the lower seat member; and, (d) an upper seat member hingedly connected at its rear to the top rear of the lower seat member, said upper seat member being contoured to form a reciprocal of the lower seat member so as to mate with the lower seat member, and support the user's posterior with the opposite surface of the cover being thus contoured similar to the lower seat member so as to also accommodate and support the posterior of the user in the seating position when in the generally horizontal position resting against the lower seat member.

* * * * *